United States Patent [19]

Stringfellow et al.

[11] Patent Number: 4,598,653

[45] Date of Patent: Jul. 8, 1986

[54] COMBUSTION SYSTEM FOR BURNING FUEL HAVING VARIOUS PARTICLE SIZES

[75] Inventors: Thomas E. Stringfellow, Aurora; Warnie L. Sage, Littleton, both of Colo.

[73] Assignee: Stearns Catalytic World Corporation, Denver, Colo.

[21] Appl. No.: 755,981

[22] Filed: Jul. 17, 1985

Related U.S. Application Data

[63] Continuation-in-part of Ser. No. 649,558, Sep. 12, 1984, Pat. No. 4,565,139.

[51] Int. Cl.[4] ..... F23D 1/00

[52] U.S. Cl. ..... 110/347; 110/245; 110/263

[58] Field of Search ..... 110/263, 245, 347; 122/4 D

[56] References Cited

U.S. PATENT DOCUMENTS

| | | | |
|---|---|---|---|
| 4,397,248 | 8/1983 | Mehta et al. | 110/263 |
| 4,475,472 | 10/1984 | Adrian et al. | 110/347 |
| 4,485,747 | 12/1984 | Pershing et al. | 110/347 |

*Primary Examiner*—Edward G. Favors

*Attorney, Agent, or Firm*—Mark L. Rodgers; E. Eugene Innis; James C. Simmons

[57] ABSTRACT

The present invention is a process and associated apparatus for obtaining energy from a fuel source having particles varying in size from fines to coarse. The fuel source is introduced into a passageway formed between an upper combustor and a lower combustor. A gas stream is moved upwardly through the passageway such that the fine particles are entrained in the gaseous stream and carried into the upper combustor.

16 Claims, 1 Drawing Figure

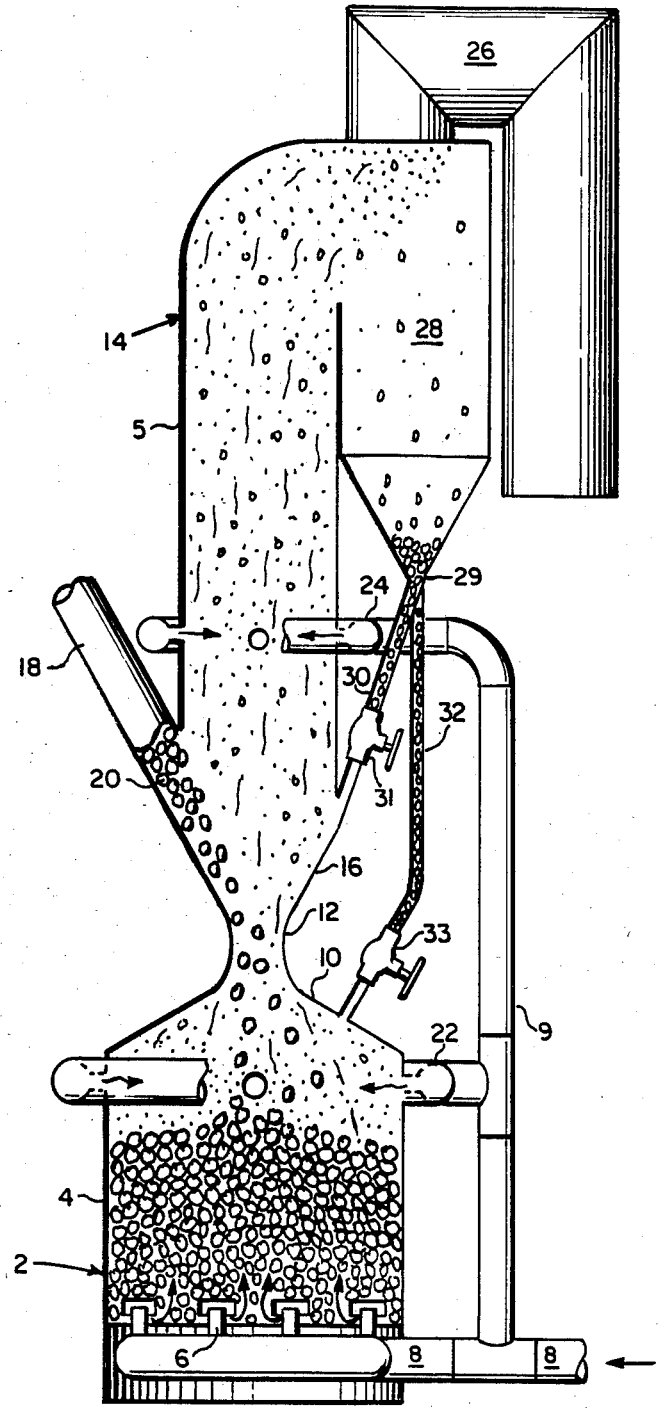
26
28
14
5
29
24
18
30
32
20
31
16
12
33
10
22
9
4
2
6
8
8

COMBUSTION SYSTEM FOR BURNING FUEL HAVING VARIOUS PARTICLE SIZES

CROSS REFERENCE TO PARENT APPLICATION

This is a continuation-in-part of U.S. patent application Ser. No. 649,558, filed Sept. 12, 1984, U.S. Pat. No. 4,565,139 the subject matter of which is hereby incorporated by reference.

TECHNICAL FIELD OF THE INVENTION

The present invention relates to a process and associated apparatus for burning fuel to obtain energy. More particularly, it involves efficiently burning fuels which comprise various particle sizes.

BACKGROUND OF THE INVENTION

Recently much effort has been made to obtain energy from sources that previously were considered unfeasible or uneconomical. Such sources include biomass, refuse, and slurry-type fuels. One specific example is the spent shale which is a product of processing oil shale. Spent shale can be defined as including the characteristics of a low BTU, low volatile content, low carbon, high ash fuel. Spent shale typically comprises a wide range of particle sizes, e.g. from fines to about 3 inches. While such spent shale contains considerable useful energy, known combustion systems have not been able to efficiently utilize this energy because of the relatively wide range of particle sizes. In known entrained or fluidized bed combustors, fine size particles; i.e., less than 1 inch, are effectively handled but such combustors are inadequate for relatively larger particles. In other types of combustors, coarse size particles; i.e., about 1–4 inches, are combusted, but such a system cannot tolerate any significant amount of smaller size particles or fines due to the unacceptably high pressure drop created by such particles.

In order to obtain useful energy from the spent shale, it has been necessary to first separate the spent shale particles into fine and coarse size particles before introducing the separated coarse particles into a combustor adapted to handle such particles and separately introducing the fine particles into another combustor adapted to handle these smaller particles. Alternatively, it has been suggested to subject the larger particles to a grinding operation to form smaller size particles. Because the spent shale is generated at a relatively high temperature; e.g., about 425° C., the grinding step causes a substantial removal of heat from the spent shale by contact with the grinding equipment. Since it is highly desirable to maintain the spent shale at this high temperature, the grinding operation results in a wasteful loss of heat.

One method for burning pulverized fuel such as pit coal is disclosed in U.S. Pat. No. 4,475,472. This method involves using a modified fluidized bed furnace such that a primary air stream supplies the pulverized fuel above the fluidized bed in the furnace. The fuel is then separated above the fluidized bed with the finer particles being burnt in the flame above the bed, and the coarse particles falling into the bed itself for combustion. The fuel is supplied to the fluidized bed furnace via a primary air pipe which extends through the fluidized bed and opens into the flame area of the burner.

BRIEF SUMMARY OF THE INVENTION

The present invention is a process and associated apparatus for obtaining energy from a fuel source having particles ranging in size from fines to coarse. The process comprises burning the fuel source in a combustion apparatus having an upper combustor and a lower combustor connected via a passageway. The fuel is introduced at a point along or directly above the passageway. A gas stream is moved upwardly through the passageway at a rate such that the fine fuel particles become entrained in the gas stream and are carried into the upper combustor while the coarse particles fall into the lower combustor. The fine particles are combusted in the upper combustor and the coarse particles are combusted in the lower combustor thereby generating heat which is used to provide useful energy.

An oxygen-containing gas stream is introduced into the lower combustor to support combustion of the coarse fuel particles. Additionally, a portion of this gas stream is moved through the passageway to separate the fuel source into fines and coarse, and finally, is introduced into the upper combustor to support combustion of the fines. The oxygen-containing gas stream moving through the passageway also contains the reaction products from the lower combustor.

The uncombusted fuel and gaseous products of combustion from the upper combustor are passed from the top of the upper combustor into a cyclonic-type separator. The smaller, uncombusted fuel particles, along with the gaseous products of combustion, exit the separator through an exhaust outlet, while the larger, uncombusted fuel particles are returned via a conduit into the passageway connecting the upper and lower combustors. Additionally, at least a portion of the larger, uncombusted particles in the separator may be passed directly into the lower combustor.

BRIEF DESCRIPTION OF THE DRAWING

The single FIGURE is a schematic illustration of a preferred embodiment of the present invention.

DETAILED DESCRIPTION OF THE INVENTION

The present invention can best be understood by referring to the accompanying FIGURE. A lower combustor 2 is conventionally mounted at a fixed, predetermined location and is preferably constructed with water jacketed walls 4. The lower combustor 2 can be any suitable type of combustion unit which is capable of combusting coarse-size fuel particles, such as a bubbling fluid bed combustor. The upper end of the lower combustor 2 is provided with slanting walls 10 to form a narrow passageway or venturi 12. An upper combustor 14 is mounted directly above the lower combustor 2 such that the passageway 12 connects the exit port of the lower combustor 2 with an inlet of the upper combustor 14. The upper combustor 14 can be any conventional type of combustion unit which is capable of combusting fine-size fuel particles, such as an entrained fluidized bed combustor. The cross-sectional area of the upper combustor 14 is substantially less than the cross-sectional area of the lower combustor 2 so that the exit of the venturi 12 adjacent to the upper combustor 14 is significantly smaller than the entrance adjacent to the lower combustor 2. The passageway or venturi 12, itself, has a smaller diameter than both the upper 14 and lower 2 combustors. As with the lower combustor 2, the upper combustor 14 is also preferably constructed with water jacketed walls 5. A fuel distributing means 18 is positioned such that combustion fuel being admitted to the combustion apparatus is introduced at a point directly above the venturi 12. The combustion fuel 20 may have a wide range of particle sizes, densities and shapes. The particle sizes generally range from fines; i.e., 1 inch or less, to coarse; i.e., 1–4 inches. Examples of suitable combustion fuels include biomass, spent shale, refuse and slurry-type fuels.

An oxygen-containing gas, such as air, is introduced into the lower combustor 2 by an oxygen distribution means 6 located along an oxygen supply line 8. This oxygen-containing gas supports combustion in the lower combustor 2, and also provides a high velocity gas stream through the venturi 12. As the fuel is distributed from the fuel distributing means 18, it is separated by the velocity of the air stream moving through the venturi 12, such that the finer size and lower density particles move with the mixture of air and combustion gases into the upper combustor 14, while the coarse size and higher density particles move downward through the venturi 12 and into the lower combustor 2 for combustion therein. The gaseous products of combustion from the lower combustor 2 flow with the uncombusted oxygen-containing gas through the venturi 12 to separate the fuel particles 20.

A secondary oxygen supply line 9 branches off from oxygen supply line 8 to supply oxygen-containing gas to an oxygen distribution means 22 positioned so as to admit an oxygen-containing gas into the lower combustor 2 at a point just below the venturi 12. This additional oxygen-containing gas assists in separating the fuel particles in the venturi 12 an also supplies oxygen for combustion in the upper combustor 14. An additional oxygen distribution means 24 from oxygen supply line 9 is located at a point along the upper combustor 14 to add additional oxygen for combustion in the upper combustor 14.

The gas stream moving through the venturi 12 is at a velocity sufficient to carry the fine size fuel particles into the upper combustor 14 for combustion therein. Typically, the velocity of the gas stream passing through the venturi is between 60 to 100 feet per second. The fine size fuel particles are carried by the mixture of air and combustion gas at a velocity of about 30–60 feet per second into the upper combustor where they are combusted at temperatures typically between 980°–1100° C. The coarse size particles which are not carried into the upper combustor 14 fall into the lower combustor 2 where they are combusted in a stirred bed of largely inert material, such as limestone if sulfur capture is desired. Typically, combustion in the lower combustor 2 takes place at a temperature between about 800°–925° C. The heat generated by the combustion of the fuel particles in both the lower 2 and upper 14 combustors is used to convert water in the water jacketed walls, 4 and 5 respectively into steam which can be used to provide useful energy. If desired, the water may be replaced with any other suitable medium which can be located in the walls of the combustors.

The gaseous products of combustion, along with some uncombusted fuel, are carried out of the upper combustor 14 into an adjacent cyclonic separator 28 in fluid communication with the upper combustor 14. The larger particles, generally still having some carbon content, fall into the lower zone of the cyclonic separator 28 while the smaller size particles, along with the gaseous products of combustion, exit from the top of the separator 28 through an exhaust outlet, such as a vent pipe 26, to further heat recovery means and solids removal equipment (not shown). The larger particles collected in the lower zone of the cyclonic separator 28 exit the separator through a lower outlet 29 and are returned to a point directly above the venturi 12 via conduit 30 for further separation and combustion. Alternately, a portion of these larger particles can be directed through conduit 32 to provide additional fuel directly to the lower combustor 2. The flow of fuel particles through conduits 30 and 32 are controlled by flow valves 31 and 33, respectively.

The above described operation permits the introduction of materials such as spent shale, biomass, refuse and/or slurries into a combustion and heat recovery unit that is capable of handling both extremely small particle size material as well as relatively large particles size material, and also a high moisture content, without the need to separate the large from the small particles by screening, followed by the separate treatment of a large and small particles; or, without the necessity of predrying. The interconnection of the upper combustor to the lower combustor by means of the narrow passageway or venturi permits the same volume of gas from the lower combustor to be increased in velocity sufficient to entrain the smaller-sized particles for movement into the upper combustor. Additionally, the heated gas from the lower combustor provides additional heat needed to dry downward falling high moisture particles and sustain combustion in the upper combustor without the necessity of supplemental fuel.

Having thus described the present invention what is now deemed appropriate for Letters Patent is set out in the following appended claims.

What is claimed is:

1. A process for obtaining energy from a fuel source having particles ranging in size from fines to coarse by combusting said fuel in a combustion apparatus having an upper combustor and a lower combustor connected via a passageway, wherein a venturi is formed in said passageway such that the velocity of gases entering the passageway from the lower combustor is increased, said process comprising:

(a) introducing the fuel source, having fine and coarse particles into the combustion apparatus, at a point along or directly above the passageway;

(b) introducing an oxygen-containing gas into the lower combustor in a quantity sufficient to support combustion in the lower combustor;

(c) moving a gas stream upwardly through the passageway such that the fine particles are entrained in the gaseous stream and carried into the upper combustor, while the coarse particles fall into the lower combustor;

(d) combusting the fine particles in the upper combustor to generate heat;

(e) combusting the coarse particles in the lower combustor to generate heat; and (f) using the generated heat to provide useful energy.

2. The process in accordance with claim 1 wherein the oxygen-containing gas stream is introduced in a quantity sufficient to support combustion in both the lower and upper combustors.

3. The process in accordance with claim 2 wherein at least a portion of the upwardly moving gas stream passing through said passageway comprises the unused oxygen-containing gas which was introduced into the lower combustor.

4. The process in accordance with claim 3 wherein a portion of the upwardly moving gas stream passing through the passageway comprises the gaseous reaction products from the lower combustor.

5. A process in accordance with claim 4 wherein the lower combustor is a bubbling fluid bed combustor and the upper combustor is an entrained fluidized bed combustor.

6. The process in accordance with claim 5 wherein the fuel source having fine and coarse particles is selected from the group consisting of spent shale, biomass, refuse, and slurry particles and mixtures thereof.

7. The process in accordance with claim 1 wherein uncombusted fuel and the gaseous products of combustion from the upper combustor are passed into a cyclonic-type separator wherein the smaller uncombusted fuel particles, along with the gaseous products of combustion, exit through an exhaust outlet, while the larger, uncombusted fuel particles are introduced, via a conduit, into the passageway between the upper and lower combustors.

8. The process in accordance with claim 7 wherein at least a portion of the larger, uncombusted particles in the cyclonic separator are passed through a conduit directly into the lower combustor.

9. The process in accordance with claim 8 wherein an oxygen-containing gas is introduced into the lower combustor at a point just below the venturi.

10. A combustion apparatus for obtaining energy from a fuel source having particles ranging in size from fines to coarse, said apparatus comprising:

(a) a lower combustor having inwardly slanting walls at its upper end forming an exit port having a smaller diameter than the diameter of the lower combustor;

(b) a passageway connecting the exit port of the lower combustor with an inlet of an upper combustor located above said lower combustor, said passageway having a smaller diameter than both the lower and upper combustors;

(c) a means for introducing said fuel source into the combustion apparatus at a point at or directly above said passageway; and (d) a means for providing a moving, gaseous stream upward through said passageway at a velocity sufficient to separate the fuel source into fines and coarse particles, whereby the coarse particles fall into the lower combustor to generate heat and the fines are entrained in the moving gas stream and carried up into the upper combustor to generate heat.

11. The combustion apparatus in accordance with claim 10 wherein the lower combustor comprises a bubbling fluid bed combustor and the upper combustor comprises an entrained fluidized bed combustor.

12. The combustion apparatus in accordance with claim 11 wherein said fuel source is selected from the group consisting of biomass, spent shale, refuse, and slurry particles and mixtures thereof.

13. The combustion apparatus in accordance with claim 12 wherein the upper combustor is in fluid communication with an adjacent cyclonic separator.

14. The combustion apparatus in accordance with claim 13 wherein said cyclonic separator has an exhaust outlet for removing gas and very small particles and also a lower outlet connected via a conduit to the combustion apparatus for returning larger uncombusted fuel particles collected in said separator.

15. The combustion apparatus in accordance with claim 14 which further comprises a means for admitting an oxygen-containing gas into the lower combustor.

16. The combustion apparatus in accordance with claim 15 which further comprises a means for admitting an oxygen-containing gas into the passageway between the lower combustor and the upper combustor.

* * * * *